US006467542B1

(12) United States Patent
Kostrov et al.

(10) Patent No.: US 6,467,542 B1
(45) Date of Patent: Oct. 22, 2002

(54) METHOD FOR RESONANT VIBRATION STIMULATION OF FLUID-BEARING FORMATIONS

(76) Inventors: Sergey A. Kostrov, 5945 W. Parker Rd., Apartment 1731, Plano, TX (US) 75093; William O. Wooden, 5928 Henley Dr., Plano, TX (US) 75093

( * ) Notice: Subject to any disclaimer, the term of this patent is extended or adjusted under 35 U.S.C. 154(b) by 7 days.

(21) Appl. No.: 09/875,839

(22) Filed: Jun. 6, 2001

(51) Int. Cl.[7] ..... E21B 43/25; E21B 28/00; E21B 47/00

(52) U.S. Cl. ..... 166/249; 166/250.02; 166/177.1

(58) Field of Search ..... 166/249, 250.01, 166/252.5, 250.02, 311, 248, 66, 177.1

(56) References Cited

U.S. PATENT DOCUMENTS 2,670,801 A * 3/1954 Sherborne
3,378,075 A * 4/1968 Bodine
3,754,598 A * 8/1973 Holloway, Jr. ..... 166/249
4,049,053 A * 9/1977 Fisher et al. ..... 166/177.1
4,437,518 A * 3/1984 Williams ..... 166/177.6
5,282,508 A * 2/1994 Ellingsen et al. ..... 166/249

* cited by examiner

*Primary Examiner*—David Bagnell
*Assistant Examiner*—Jennifer Dougherty

(57) ABSTRACT

A process is provided to enhance fluid production, recovery, and/or injection from and/or into fluid-bearing formations. The process includes the stimulation of the formation by vibrations, generated by the vibration source installed in the vicinity of the productive layer so that the stimulation is performed on the frequency coinciding with the eigen frequency bandwidth of filtration process of productive layer/sublayer.

3 Claims, 2 Drawing Sheets

METHOD FOR RESONANT VIBRATION STIMULATION OF FLUID-BEARING FORMATIONS

TECHNICAL FIELD

The present invention relates to a vibration generating method and device and, more particularly, to a method and device for generating vibrations in a well borehole to remove a region of reduced permeability and to increase filtration rate through porous media thereby increasing fluid recovery, production and/or injection from and/or into fluid bearing formations.

BACKGROUND OF THE INVENTION

The acoustic or vibration stimulation of wells is a known technique for enhancing oil production and recovery from oil-bearing strata as is described in: "Elastic-Wave Stimulation of Oil Production: A Review of Methods and Results", Geophysics Vol.59 No. 6 (June 1994).

Various methods and apparatuses for imparting vibrations to a well in order to clean the near well zone or remove a region of reduced permeability are known in patented prior art.

U.S. Pat. No. 5,282,508, for example, refers to a formation stimulation method that simultaneously: (a) reduces the adherence forces in the layer between oil-water and the rock formation by superimposing elastic sound waves created by a sonic source installed in the well, while (b) applying an oscillating electrical stimulation of the stimulated wellbore region. One disadvantage of this invention is that it requires a continuous application of substantial quantities of energy to heat the near-well zone.

A disadvantage of prior art is use of non-eigen vibration frequency. The eigen frequency of a given porous media is defined as that frequency generated by the flow of fluid through the given porous media. Typically, it not a single frequency rather it is a spectrum of frequencies or a bandwidth. The bandwidth results from the fact that porous media is non-uniform in structure and pore size. The eigen frequency/bandwidth is often referred to as the eigen filtration frequency. Under conditions of non-eigen frequency vibrational stimulation it is impossible to reach the resonance phenomenon observed for filtration processes in fluid saturated porous media. The method for determining the filtration eigen frequency is found for example in USSR Pat. No. 1,477,900. For example, the eigen frequency of calcium carbonate formations lies in the bandwidth of 0.5–2.5 kHz (kilohertz) and the eigen frequency of sandstone formations lies in the bandwidth of 1.5–20 kHz. The eigen frequency of any given porous media depends on pressure, permeability, porosity, oil/water saturation, and oil/water properties.

The USSR Pat. No. 1,595,061 discloses a method and apparatus wherein a so-called hydrodynamic wave generator is arranged at the end of tubing and is installed into a wellbore opposite to the productive sub-layer having a region of reduced permeability due to contamination by drilling mud, fines, sand, etc. The other end of the tubing is connected to a pump in turn connected to a tank holding a liquid (e.g. water or crude oil).

The tank is connected to the wellbore casing inside which is installed the tubing, thereby providing the possibility of circulating the liquid in the system loop containing, in order: the pump, tubing, hydrodynamic wave generator, casing, tank, and returning again to the pump. The hydrodynamic wave generator creates high frequency vibrations that remove the region of reduced permeability. However, like all prior art, this method describes stimulation under conditions of non-resonance between the eigen frequency of the formation and the stimulation frequency of hydrodynamic wave generator.

Attention is also invited to U.S. Pat. Nos. 2,670,801; 3,378,075; 3,754,598; 4,049,053; 4,437,518.

The present invention was developed to overcome these and other drawbacks of prior methods by providing an improved method for the resonant stimulation of the near well zone of well.

SUMMARY OF INVENTION

The method in accordance with invention includes the measurement of the eigen frequencies of the filtration process in a productive reservoir by means of the downhole sensor installed on the depth of the productive layer in the active injection/producer well, installation of the vibration source (so-called wave generator) at the depth of productive layer/sublayer which is needed to be stimulated, installation of the vibration sensor in the vicinity of source of vibration and the performing the stimulation of the productive layer/sublayer on the vibration frequency corresponding the eigen frequency of the productive layer/sublayer which is needed to be stimulated. The stimulation frequency of the vibration source is measured by the vibration sensor and is transmitted to the surface in order to tune the vibration source to the eigen frequency of formation. An advantage of the present invention is that the stimulation of the productive layer/sublayer(s) is performed under the conditions of resonance thereby essentially increasing the mobility of fluid in the saturated porous medium of the productive formation, thereby substantially improving the cleaning action of vibration hence increasing the ability to produce, recover, and/or inject fluids.

DETAILED DESCRIPTION

Figure 1:
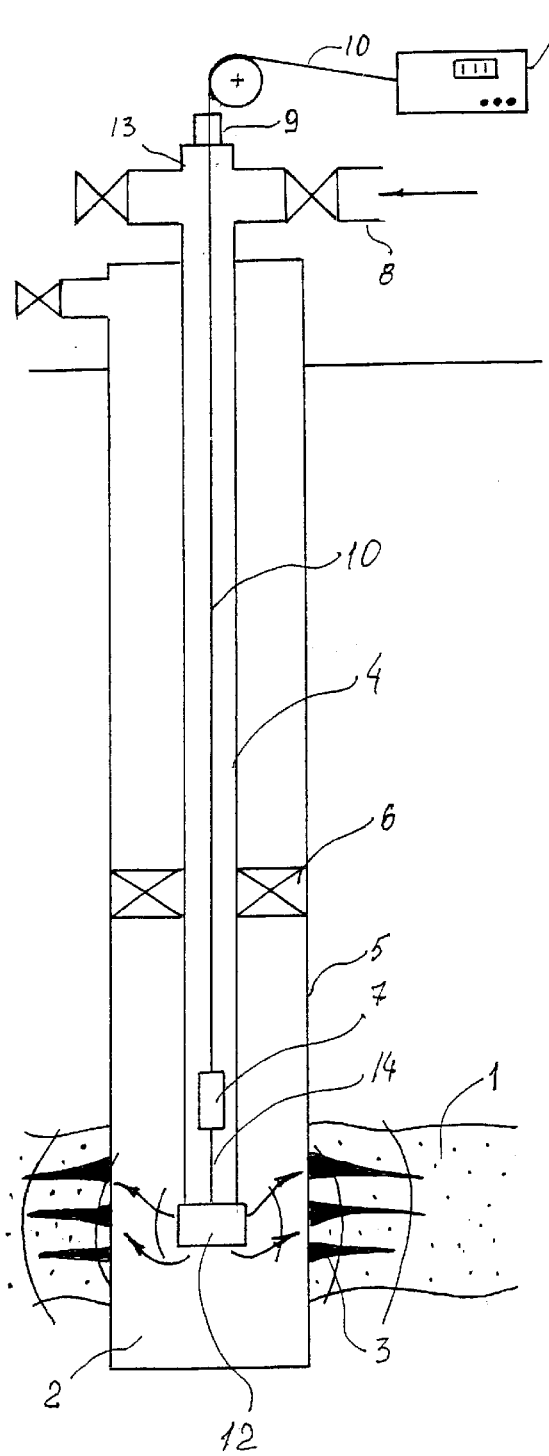
FIG. 1 shows a schematic arrangement of the measurement of eigen formation frequency.
Figure 2:
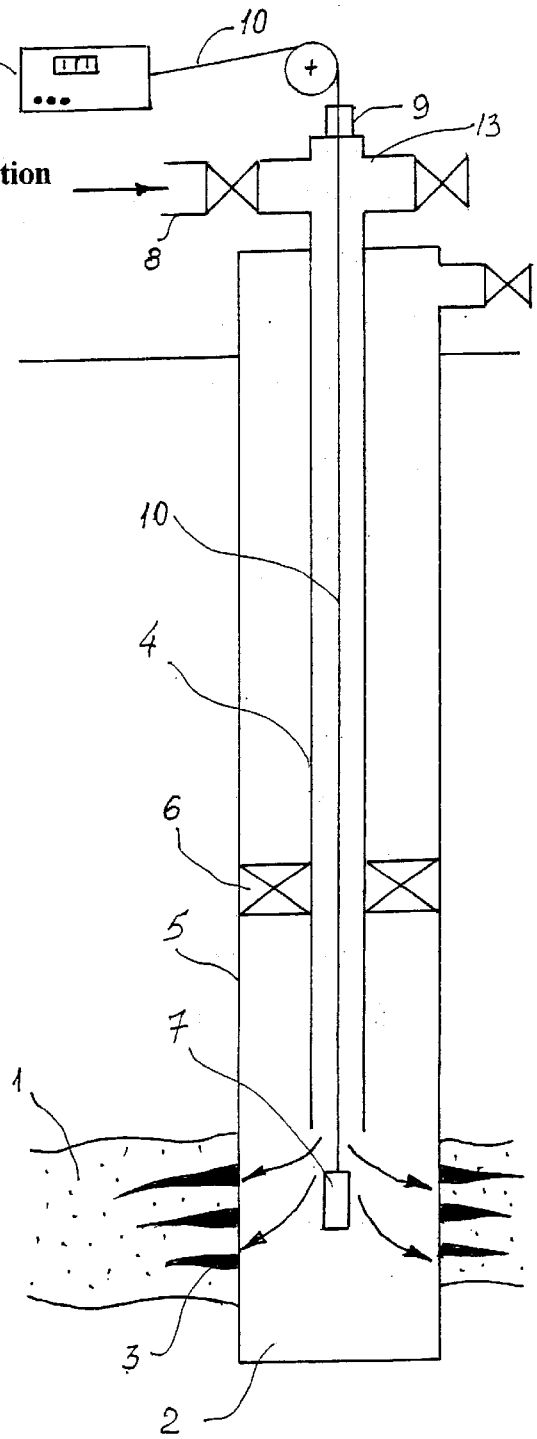
FIG. 2 shows a schematic arrangement of stimulation of near well zone by the wave generator.

Referring to FIG. 1 and FIG. 2, there is shown a vibration sensor 7 suspended on the wire line 10 in the vicinity of the productive layer 1 (FIG. 1 and in vicinity of the wave generator 12, FIG. 2) and connected to the vibroanalizer/computer 11. The injection/production well 2 has the perforations 3 in a casing 5, tubing 4 and packer 6 (usually installed in the injection well but the operation can be carried out without it). The lubricator 9 is connected to Tee-tubing which in turn connected to the injection (flow) line 8 and the lubricator 9 prevents the leaks of liquid from tubing 4 during the measurement of eigen frequency by the vibration sensor 7. As shown on FIG. 2 the wave generator 12 is installed at the end of tubing 4 (optional) in the vicinity of perforations 3 which are needed to be stimulated.

OPERATION

FIG. 1 shows a general arrangement of the measurement of eigen frequency of formation by the means of installation of the vibration sensor 7 in the injection well 2. The vibration sensor 7 is suspended on wire-line 10 connected with vibroanalizer (computer) 11 which determines the spectrum of oscillation created by the filtration process of fluid in the productive formation 1. The signal from the vibration sensor 7 is transmitted to the vibroanalizer 11 via wire-line 10. Therefore the vibration spectrum can be measured for each productive sublayer by the moving of the vibration sensor 7 up and down along the perforations 3 thereby measuring the eigen frequency or eigen frequency bandwidth for each productive sublayer. Moreover it's possible to determine the presence or absence of the unswept productive sublayers based on the level of noise generated by filtration process in the formation. In other words, if there is no such noise coming from any particular sublayer it means the presence of an unswept sublayer. This technique is relatively similar with the spinner log in the sense of determining of the presence of the unswept sublayers.

Figure 3:
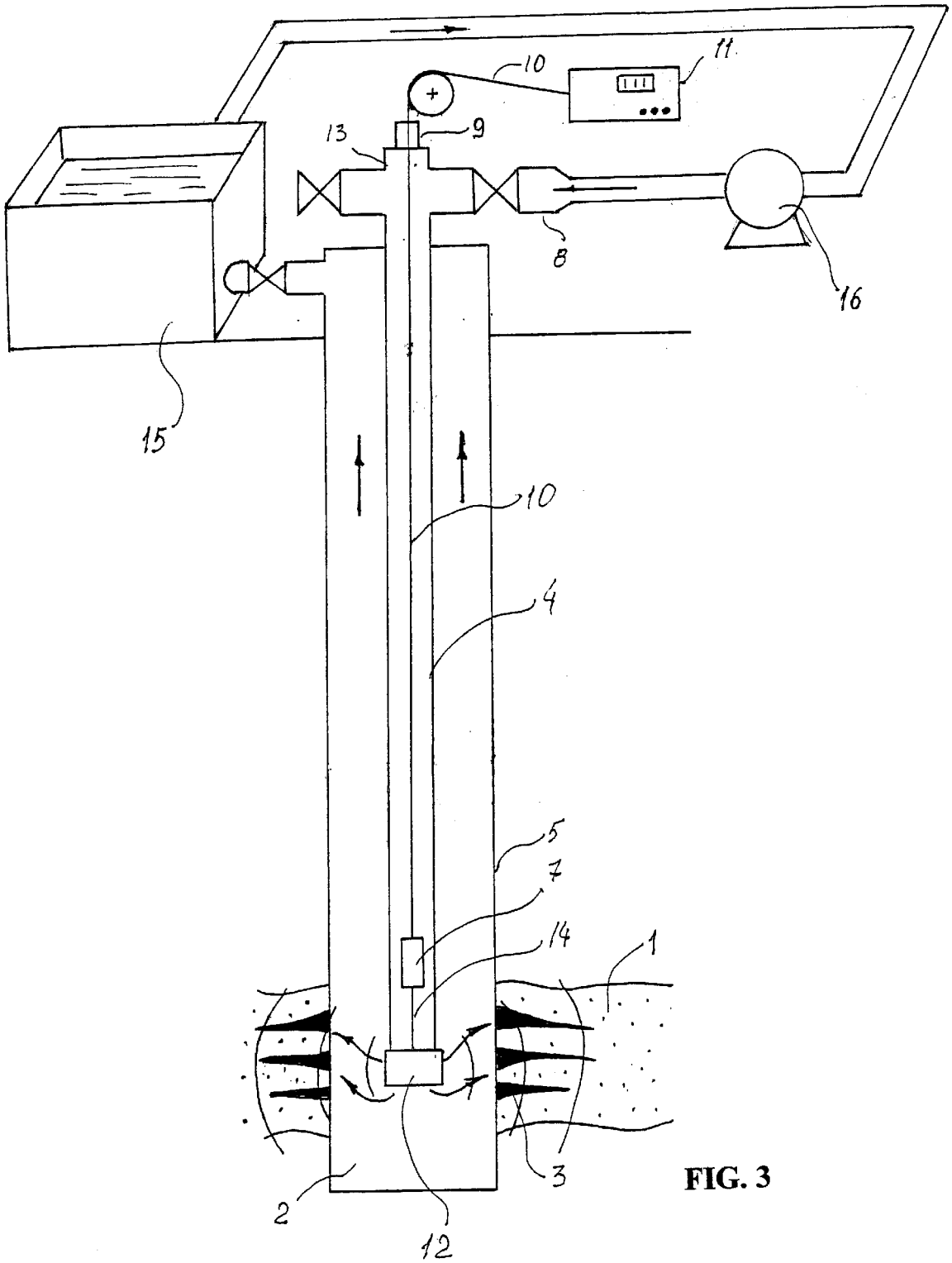
FIG. 3 shows a schematic arrangement of stimulation of near well zone by the wave generator in the regime of circulation.

FIG. 2 shows the stimulation of productive layer 1 (or particular sublayer of productive layer 1) by the wave generator 12 that generates the vibrations on the eigen frequency (or bandwidth) of productive layer/sublayer 1. The sensor 7 measures the frequency generated by wave generator 12, transmit it to the vibroanalizer 11 and the exact tuning of the wave generator 12 is performed by means of the changing of flow-rate or pressure of liquid via the wave generator (if wave generator is driven by the flow of fluid) or electrically using the control cable 14. The stimulation of the productive layer 1 of the production well 2 is carried out either during the active period of production or in the regime of circulation of fluid in accordance to the following loop: tank with fluid 15 (FIG. 3)—pump 16 connected to the tank with fluid 15—tubing 4—wave generator 12—casing 5—tank with fluid 15.

The stimulation of the productive layer under conditions of resonance between eigen frequency of formation and the wave generator frequency allows substantial increases in mass transfer in porous medium and removal the region of reduced permeability, that is, cleaning the near well zone. In an application of an affection frequency bandwidth of 2.5–3.1 khz with amplitude 0.1 Mpa, oil production in a sandstone was increased by 4.2 times from 90 barrels of oil per day to 400 bbls/d.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

Having described the invention, we claim:

1. A method of stimulation of near well zone by vibration comprising the steps of:

arranging a vibration sensor in the vicinity of a productive layer of the active well;

measuring the eigen frequency bandwidth of filtration process for each sublayer of the productive layer using the vibration sensor by means of movement of the vibration sensor up and down along the productive layer;

providing a source of vibration installed in the region of the productive layer/sublayer said vibration sensor is located in the vicinity of the source of vibration generating vibrations on a frequency bandwidth corresponding to the eigen frequency bandwidth of the productive layer, said vibration sensor measures the frequency of said vibration source for adjusting a frequency bandwidth of said vibration source to the said eigen frequency bandwidth of the said productive layer.

2. A method as defined in claim 1, wherein a particular sublayer of said productive layer is stimulated by said vibration source on the frequency bandwidth corresponding to the eigen frequency bandwidth of said particular sublayer of said productive layer.

3. A method as defined in claim 1, wherein the measurement of the eigen frequency bandwidth of the productive layer and adjusting a frequency bandwith of said vibration source to the said eigen frequency bandwidth of the productive layer are performed simultaneously.

* * * * *